US012421744B2

(12) United States Patent
Breton

(10) Patent No.: US 12,421,744 B2
(45) Date of Patent: Sep. 23, 2025

(54) SYSTEM AND PROCESS FOR SEALING A FOUNDATION CRACK

(71) Applicant: GESTION LOGISCASA INC., Quebec (CA)

(72) Inventor: Daniel Breton, Quebec (CA)

(73) Assignee: GESTION LOGISCASA INC., Quebec (CA)

( * ) Notice: Subject to any disclaimer, the term of this patent is extended or adjusted under 35 U.S.C. 154(b) by 226 days.

(21) Appl. No.: 18/318,366

(22) Filed: May 16, 2023

(65) Prior Publication Data

US 2024/0384548 A1 Nov. 21, 2024

(51) Int. Cl.
*E04G 23/02* (2006.01)

(52) U.S. Cl.
CPC ..... *E04G 23/0229* (2013.01)

(58) Field of Classification Search
CPC . E04G 23/0229; E04G 23/0218; E04G 23/02; E02D 5/02; E02D 5/04; E02D 5/16; E02D 5/54; E02D 5/64; E02D 17/207; E02D 27/30; E02D 17/08
See application file for complete search history.

(56) References Cited

U.S. PATENT DOCUMENTS

D755,410 S * 5/2016 Geldart ..... D25/138
2002/0067959 A1* 6/2002 Thornton ..... E04H 12/2215 405/262
2008/0229702 A1* 9/2008 Davidson ..... E02D 17/086 182/99
2014/0112726 A1* 4/2014 Pateuk ..... E02D 17/08 405/284
2014/0369753 A1* 12/2014 Poff ..... E02D 29/02 405/15

FOREIGN PATENT DOCUMENTS

JP S603144 Y2 * 1/1985
KR 20080006569 U * 12/2008
KR 100967652 B1 * 7/2010
KR 20100072510 A * 7/2010
KR 20230011082 A * 1/2023
KR 20230042982 A * 3/2023

* cited by examiner

*Primary Examiner* — Theodore V Adamos
(74) *Attorney, Agent, or Firm* — Agence de Brevets Fournier

(57) ABSTRACT

A method and system for sealing or preventing a crack in a foundation includes a modular covering panel having a bezeled lower edge defining a blade to ease insertion and lowering of the covering panel in a ground along a foundation, in contact therewith. The modular covering panel being configured to define a rigid open-top pocket on the foundation to receive a hardening sealing material so as to define a waterproof barrier on the cracked wall. The covering panel is formed with starter and main panel modules which are inserted in the ground flush along the foundation one row after another, and for each row, in sequence, a starter panel module and then a plurality of main panel modules coplanar one on top of the other.

41 Claims, 13 Drawing Sheets

SYSTEM AND PROCESS FOR SEALING A FOUNDATION CRACK

FIELD

The present disclosure relates to foundations repair and more specifically to a system and process for sealing or preventing a crack in a foundation.

BACKGROUND

There are two main known processes for repairing a cracked foundation.

The first one consists in excavating the ground at least in front of the foundation so as to access the crack. This involves excavating a good distance to yield sufficient space for workers to access the foundation with equipment. While such process is usually efficient in repairing the foundation, it involves the use of machinery, it is long and very costly, and it causes damages to the layout in front of the foundation.

The other category of crack repairing processes consists in repairing the foundation from the inside and involves filling the crack with a hardening liquid. Such process is less costly than the excavation process but is rarely 100 percent efficient considering the difficulty in reaching the exterior side of a crack.

SUMMARY

According to an illustrative embodiment, there is provided a system for sealing or preventing a crack in a foundation, the system comprising:

a modular covering panel having a bezeled lower edge defining a blade to ease insertion and lowering of the covering panel in a ground along the foundation, in contact therewith; the modular covering panel being configured to define a rigid open-top pocket on the foundation to receive a hardening sealing material so as to define a waterproof barrier on the foundation.

According to another illustrative embodiment, there is provided a kit for sealing a crack in a foundation, the kit comprising:

a plurality of main panel modules, each including front and back faces, complementary engaging top and bottom sides that are adapted to join two of the main panel modules coplanar one on top of another when the front side faces thereof are on a same side, and complementary interlocking first and second lateral sides that are adapted for joining two of the main panel modules side by side when the front side faces thereof are on a same side; the first and second lateral sides of each main panel modules being further configured for relative slidable engagement; and a plurality of starter panel modules, each including front and back faces, top and bottom sides, and complementary interlocking first and second lateral sides that are adapted for joining two of the starter panel modules side by side when the front side faces thereof are on a same side; the first and second lateral sides of each starter panel modules being further configured for relative slidable engagement with respectively the second and first lateral sides of i) another starter panel module or ii) one of the plurality of main panel modules, when the front side faces thereof are on a same side; the top side of each starter panel module being configured for complementary engagement with the bottom side of any one of the plurality of main panel modules; the bottom side of each starter module being tapered, yielding a slanted portion on the front face thereof, wherein a bottom edge thereof is the thinnest portion thereof so as to facilitate an insertion of each starter panel module in a ground;

whereby, in operation, a least one of the plurality of starter panel modules and the plurality of main panel modules being assembled one row after another, and for each row, in sequence, the at least one of the plurality of starter panel modules and then a plurality of main panel modules coplanar one on top of the other to form a modular covering panel in the ground; the modular covering panel being configured to define a rigid pocket on the foundation. comprising:

According to still another illustrative embodiment, there is provided a process for sealing or preventing a crack in a foundation, the process comprising:

inserting in a ground, flush along the foundation, one row after another, and for each row, in sequence, a starter panel module and then a plurality of main panel modules coplanar one on top of the other to form a modular covering panel along the foundation; a bottom side of each starter panel module being tapered so as to ease an insertion of the starter panel module in the ground; a top side of each of the starter and main panel modules being configured for complementary engagement with a bottom side of the main panel modules; together the rows of starter and main panel modules defining a rigid open-top pocket on the foundation.

According to yet another illustrative embodiment, there is provided a process for sealing a crack in a foundation, the process comprising:

providing a plurality of main panel modules, each including front and back faces, complementary engaging top and bottom sides that are adapted to join two of the main panel modules coplanar one on top of another when the front side faces thereof are on a same side, and complementary interlocking first and second lateral sides that are adapted for joining two of the main panel modules side by side when the front side faces thereof are on a same side; the first and second lateral sides of each main panel modules being further configured for relative slidable engagement;

providing a plurality of starter panel modules, each including front and back faces, top and bottom sides, and complementary interlocking first and second lateral sides that are adapted for joining two of the starter panel modules side by side when the front side faces thereof are on a same side; the first and second lateral sides of each starter panel modules being further configured for relative slidable engagement with respectively the second and first lateral sides of i) another starter panel module or ii) one of the plurality of main panel modules, when the front side faces thereof are on a same side; the top side of each starter panel module being configured for complementary engagement with the bottom side of any one of the plurality of main panel modules; a portion of each starter module being tapered towards the bottom side thereof, yielding a slanted portion on the front face thereof, wherein the bottom edge thereof is the thinnest portion thereof so as i) to facilitate an insertion of each starter panel module in a ground, and ii) scrape the foundation;

attaching in a first row one of the plurality of starter panel modules and a number of the plurality of main panel modules by:

partially inserting in the ground from its bottom side said one of the plurality of starter panel modules with its back face being substantially flush with the foundation; said one of the plurality of starter panel modules becoming an upper most panel module;

sequentially attaching each of the number of the plurality of main panel modules by:

complementary engaging the bottom side of said each of the number of the plurality of main panel modules with the top side of the upper most panel module; and completely inserting in the ground the previous panel module by partially inserting in the ground said each of the number of the plurality of main panel modules;

the first row becoming a previous row;

adding each new row by repeating 1) and 2) by first slidably engaging one of the first and second lateral sides of any new one pf the plurality of starter and main panel modules with the other one of the first and second lateral sides of the upper most panel module of the previous row of modules.

It is to be noted that the expression foundation is not to be limited in any way and should be construed as including any wall at least partially extending in the ground.

The expression hardening, relatively to a sealing material, is not to be limited to any hardness of the sealing material but is to be construed as a sealing material that will pass from the liquid to solid state after a certain time and under certain conditions, usually, but not exclusively, under contact with air.

Other objects, advantages and features of the system and process for sealing a foundation crack will become more apparent upon reading the following non-restrictive description of preferred embodiments thereof, given by way of example only with reference to the accompanying drawings.

DETAILED DESCRIPTION

Figure 1:
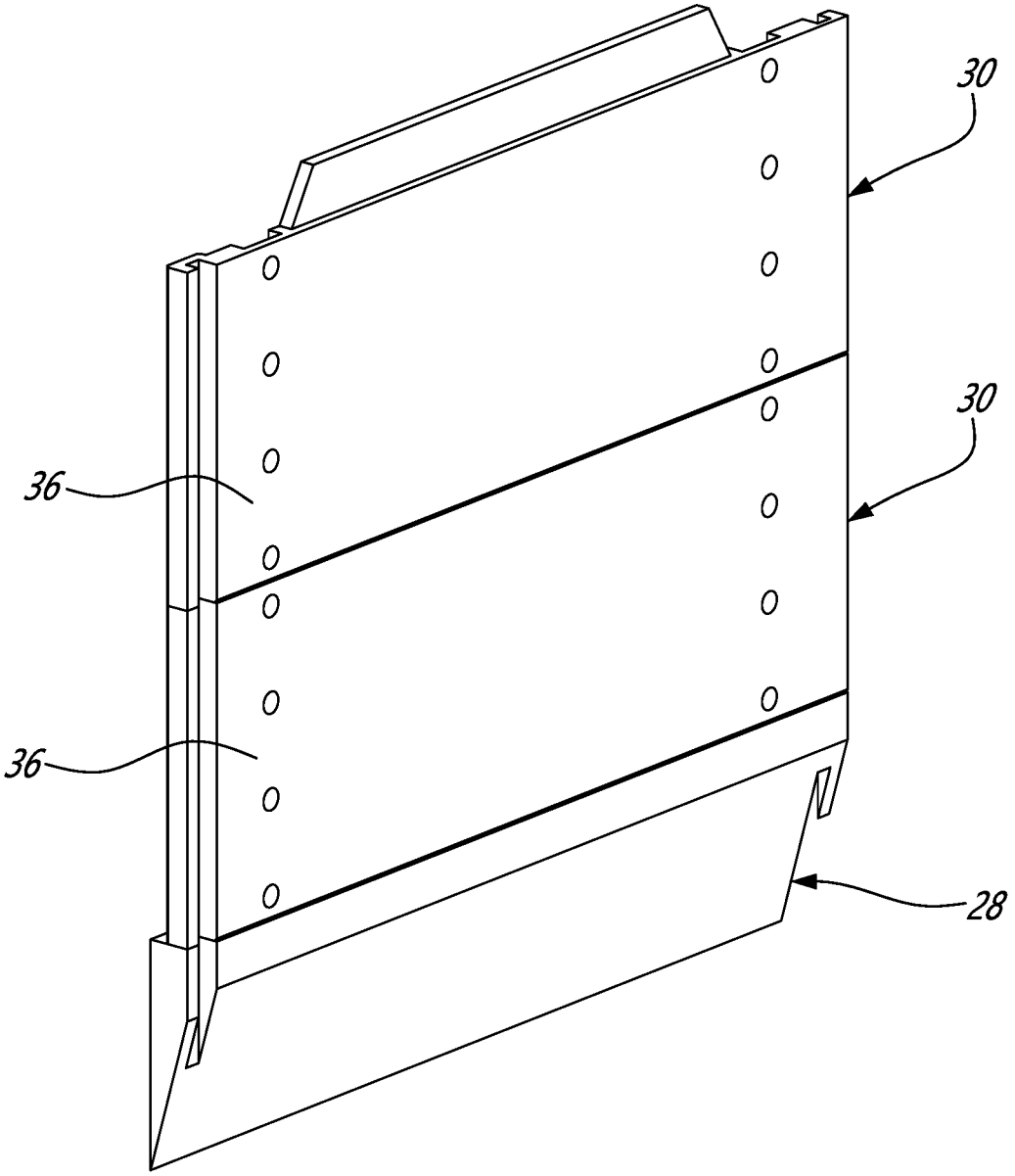
FIG. 1 is a front perspective view of an assembly of two main panel modules and of a starter panel module according illustrative embodiments, the panel modules being mounted on top of each.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

Figure 6:
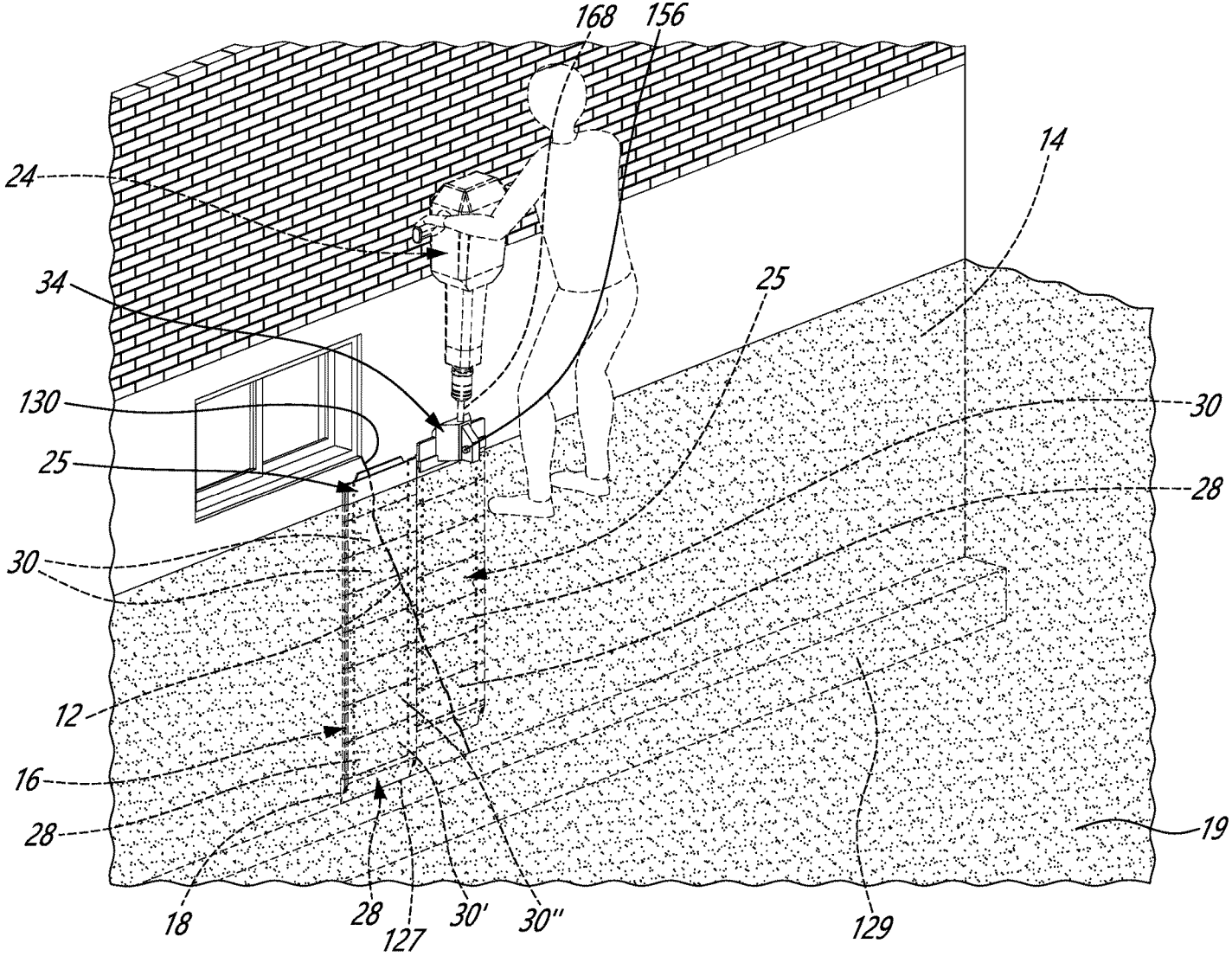
FIG. 6 is a front perspective showing the insertion in the ground of two rows of panel modules along a cracked foundation, using a jackhammer and a jackhammer-to-panel module coupler.

A system 10 for sealing or preventing a crack 12 in a foundation 14 according to a first illustrative embodiment will be described with reference first to FIGS. 6 and 10.

The system 10 comprises a modular covering panel 16 having a bezeled lower edge 18 defining a blade to ease insertion and lowering of the covering panel 16 in a ground 19 along the cracked foundation 14, in contact therewith. As will become more apparent upon reading the following description thereof, the modular covering panel 16 is configured to define a rigid open-top pocket on the foundation 14 that can receive from the open top 20 a hardening sealing material 22 so as to define a waterproof barrier on the cracked foundation 14. The system 10 includes the modular covering panel 16 and the hardening sealing material 22.

The covering panel 16 is formed of plurality of generally rectangular starter and main panel modules 28 and 30. A conventional tool, such as a jackhammer 24 can be used for inserting the panel 16, by adding one row 26 of panel modules 28 and 30 at a time, and, for each row 26, one panel module 28 or 30 at a time, one on top of the other, starting with a starter panel module 28.

The system 10 can be provided in a kit comprising a plurality of starter panel modules 28, a plurality of main panel modules 30, and the sealing material 22, with or without tools for installing the system 10, such as a sealing material discharger 32 and jackhammer-to-panel module coupler 34.

Each of these components 22 and 28-34 of the system 10, or of the kit for forming the system 10, will now be described in more detail.

With references first to FIGS. 1 to 5, the starter and main panel modules 28 and 30 will now be described.

According to the illustrative embodiment, the starter and main panel modules 28 and 30 are made of calcium carbonate filled polyethylene and result from a molding process. According to another illustrative embodiment, the modules 28 and 30 are made of another rigid material, such as fiberglass, polypropylene, polyethylene, polyvinyl chloride, aluminum, steel, etc. and/or are manufactured using another process than moulding.

Figure 5:
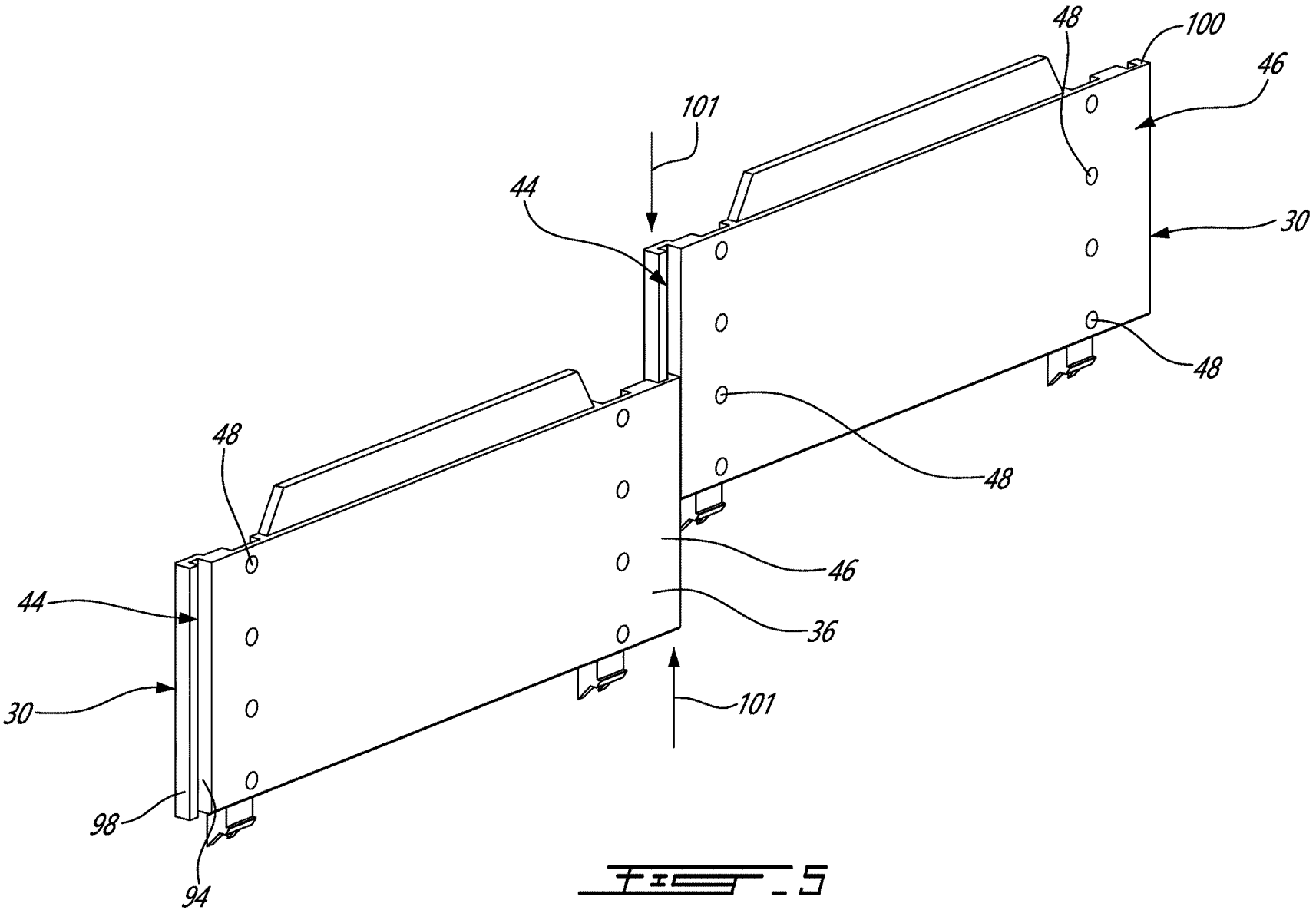
FIG. 5 is a front perspective view illustrating the assembly method of two main panel modules according to the first illustrative embodiment by slidable engagement.

Each main panel module 30 includes front and back faces 36-38, complementary engaging top and bottom portions 40-42 that are adapted a) to join two of the main panel modules 30 coplanar one on top of the other when the front side faces 36 thereof are on a same side and b) to lock the modules 30 when they are thus joined, and complementary interlocking first and second lateral side portions 44-46 that are adapted for joining two of the main panel modules 30 side by side when their front side faces 36 are on a same side. The first and second lateral sides 44-46 of each main panel module 30 are further configured for relative slidable engagement as shown in FIG. 5.

The front face 36 is substantially smooth and includes two rows of aligned circular recesses 48, each row near a respective first and second lateral sides portion 44-46. Each of the circular recesses 48 in a row is longitudinally registered with a circular recess 48 in the other row 48. The recesses 48 defines guides that can be used for receiving fasteners (not shown) to attach the upmost main module 30 to the foundation 14 in some applications.

The back face 38 is provided with a plurality of central and lateral reinforcing elongated protrusions 50 and 52 to add rigidity to the panel 30 to prevent deformation thereof under the impact force of the tool 24 used to force a row 25 of panels 28-30 into the ground 19.

Each of the protrusions 50 and 52 includes a plurality of rounded notches 54 therein, which facilitates the flow of sealing material 22 along the width of the panels 30. According to another illustrative embodiment, the number, configuration, or location of the protrusions 50-52 or of the notches 54 is different than illustrated, depending, for example, on the nature of the sealing material 22 and/or on the material used in molding the modules 30.

The lower end 56 of each of the protrusions 50-52 is bezeled, which aims at easing the lowering of the modules in the ground 19.

The upper ends 58 of the central protrusions 50 are flat and extends further up than the upper ends 60 of the lateral protrusions 52. As will be described hereinbelow in more detail, the upper ends 58 together define a first support ledge for the jackhammer-to-main panel module coupler 34.

The back face 38 includes a trapezoid upper portion 40 that extends upwardly beyond the front face 36 along most of the width of the module 30 and defines a male connecting portion. The lower portion of the back face 38 includes a recess 62 that defines a female connecting portion that is shaped to complementary receive the trapezoid upper portion 40 of another module 30 when the two modules 30 are mounted coplanar one on top of the other.

The trapezoid upper portion 40 defines a shoulder portion 64 with the front face 36, which defines a second support ledge for the jackhammer-to-main panel module coupler 34, the upper end 66 of the trapezoid upper portion 40 defining a third support ledge for the jackhammer-to-main panel module coupler 34.

The module 30 includes two male locking members in the form of double-tongue members 68, secured to the back face 38 so as to extend downwardly therefrom near a respective one of the two lateral side portions 44-46. Each member 68 are defined by two parallel tabs 70, each with a bezeled tip 72 that is defined by a slanted edge 74 oriented towards the front face 36. The straight portions of the two parallel tabs 70, on the side of the front face 36, are bridged by a small wall 76, which is set back from the front face 26 so as to define a shoulder portion 78 therewith. The lower side of the small wall 76 is provided with a small, angled ledge, defining a hook 80. On their side opposite the small wall 76, both tabs 70 includes rounded notches 54 for same reason described hereinabove.

The upper side of the back face 38 is provided with two female locking members 82, each being vertically aligned with a corresponding male locking portions 68. Each of the female locking portion 62 are defined by a rectangular recess 84 having therein a locking member 86. The locking member 86 includes an upper slanted portion 88 and a lower straight portion 90, which defines a rectangular recess 92 with the lower portion of the rectangular recess 84.

Figure 2:
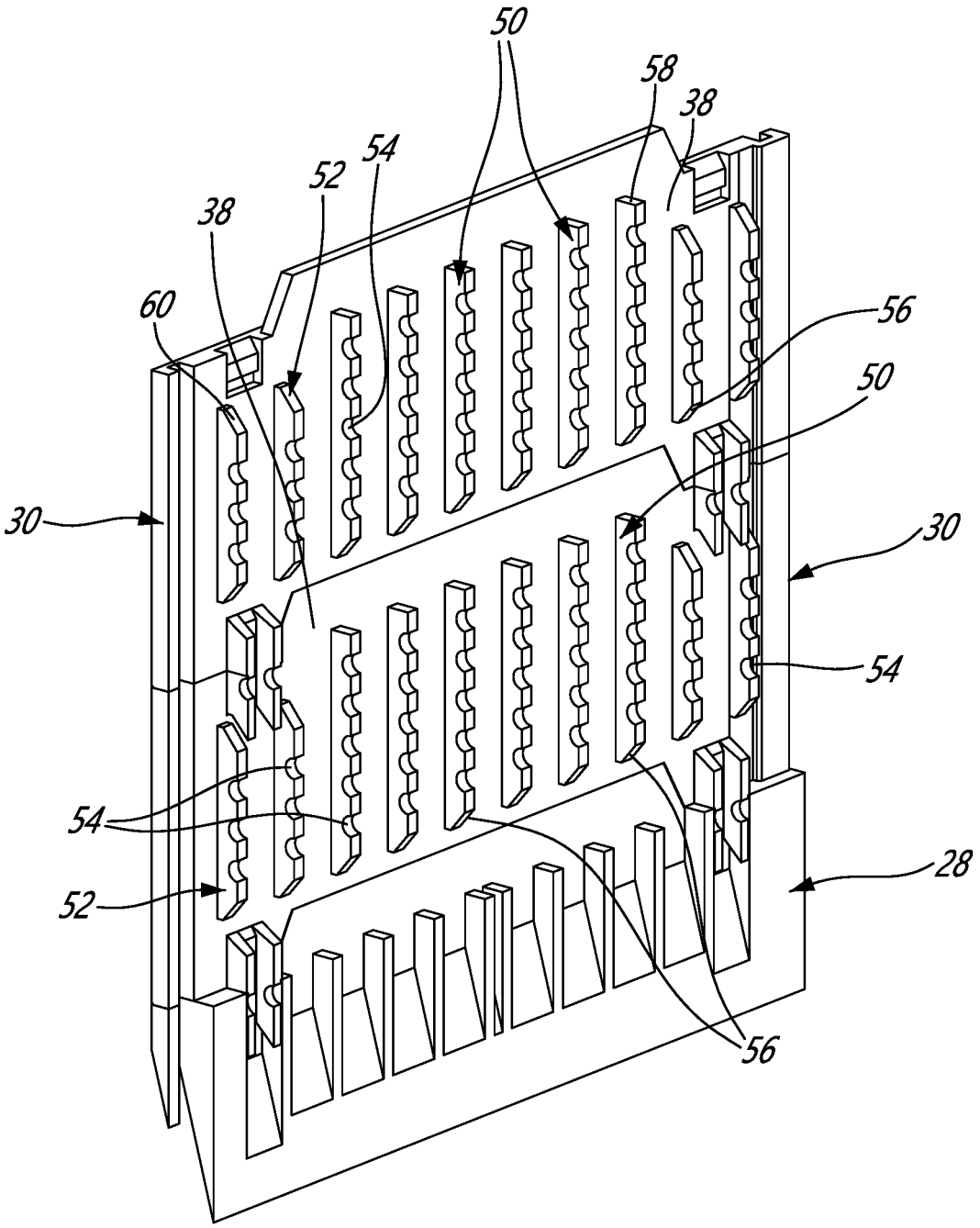
FIG. 2 is a back perspective view of the assembly from FIG. 1.
Figure 3:
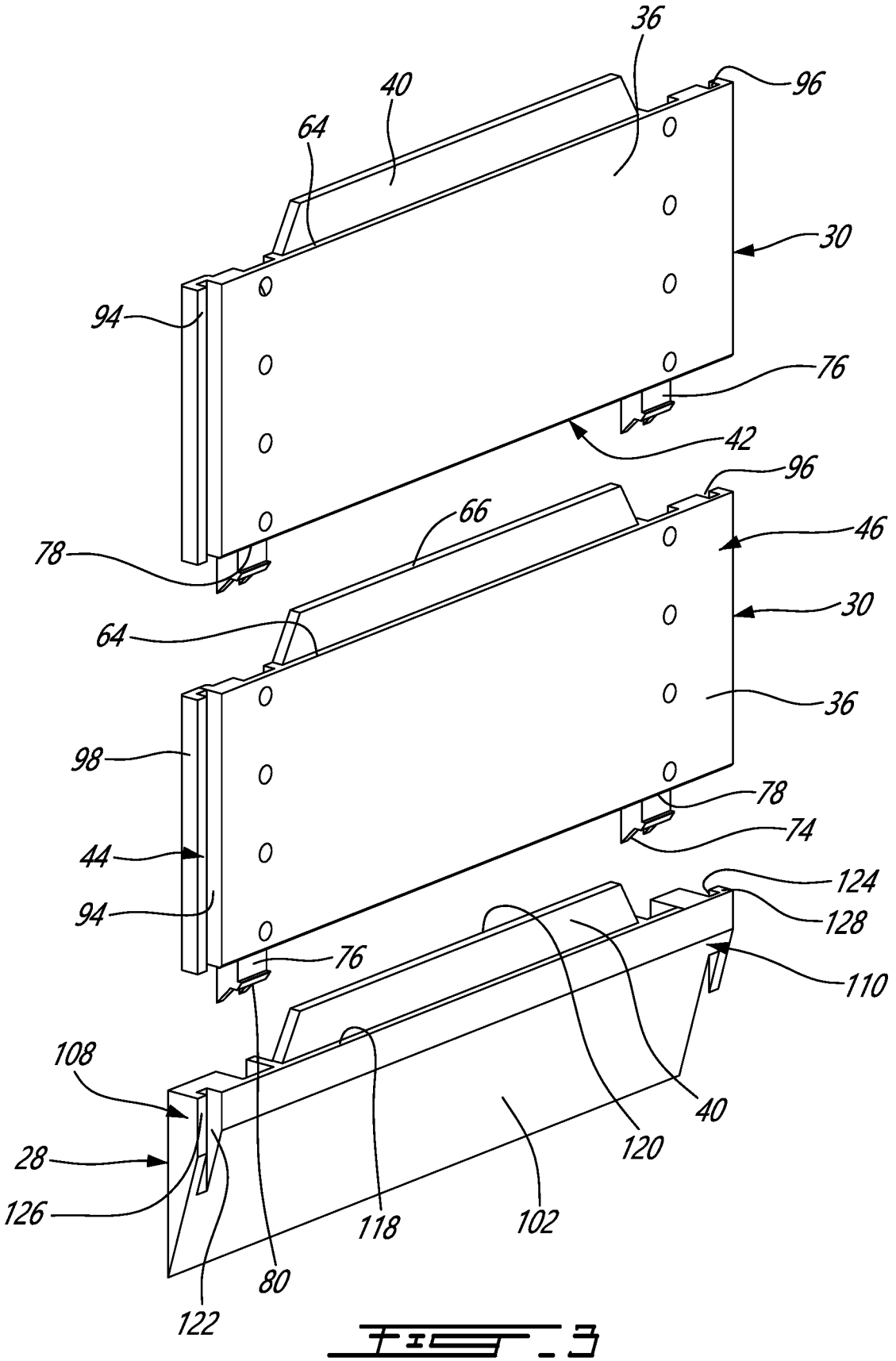
FIG. 3 is an exploded front perspective view of the assembly from FIG. 1
Figure 4:
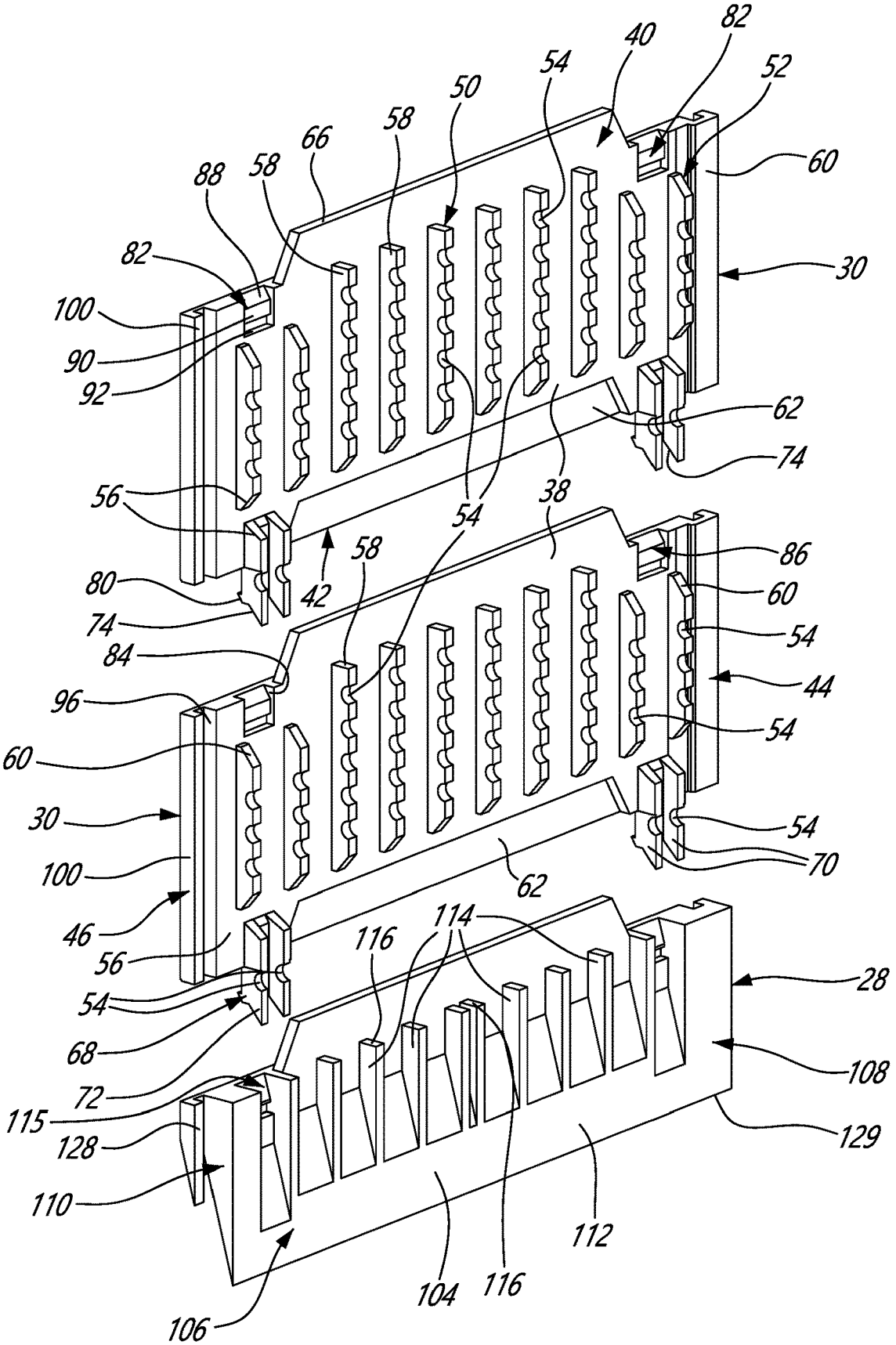
FIG. 4 is an exploded back perspective view of the assembly from FIG. 1.

With references specifically to FIGS. 2 and 4, the male and female locking members 68 and 82, are configured for complementary locking engagement, which locks two modules 30 in close engagement when the two modules 30 are mounted coplanar one on top of the other as described also hereinabove.

More specifically, the width of the male and female locking members 68 and 82 are substantially identical for snugly fit engagement, and the lower straight portions 90 and rectangular recesses 92 of the female locking members 82 are dimensioned for snugly engagement with respectively the small walls 76 and hooks 80 of the male locking portions 68. Finally, the slanted edge 74, the angle of the hook 80 and the upper slanted portions 88 ease the engagement of the male locking portions 68 in the female locking portions 82.

According to another illustrative embodiment (not shown), the panels 30 includes different locking members than those illustrated.

The first and second lateral side portions 44 and 46 include grooves 94 and 96 respectively, the former being opened on the side of the front face 36 and the latter being opened on the side of the back face 38, and each defining an outer lateral rail 98 and 100.

As can be seen in FIG. 5, the first and second side portions 44 and 46 of two different modules 30 can be slidably engaged, by inserting from the top or bottom, the rails 98 or 100 of one module 30, in the groove 96 or 94 of the other module 30, and then by simply relatively sliding one into the other (see arrows 101).

The starter panel module 28 has some similarities with the main panel module 30, which will be described only briefly herein for concision purposes, and differences therewith, which will be described herein in more detail.

Each starter module 28 includes front and back faces 102-104, connecting upper portion 40, that is adapted a) to join a main panel module 30 coplanar on top of the starter panel module 28 when the front faces 36 and 102 are on a same side and b) to lock both the starter and main modules 28-30 when they are thus joined, a bezeled lower portion 106, and complementary interlocking first and second lateral portions 108-110 that are adapted for joining two starter panel modules 28 side by side when their front side faces thereof 36 are on a same side. The first and second lateral sides 108-110 of each starter panel module 28 are further configured for relative slidable engagement, with respectively the second and first lateral sides 46 and 44 of a main panel module 30.

The back face 104 has a generally flat U-shaped portion 112 spanning the lower portion 106 and the first and second lateral sides 108-110, and the front face 102 defines an acute angle with the U-shaped portion 112 on the back face 104, defining a bezeled lower portion 106. As will be described hereinbelow in more detail, the bezeled lower portion 106 is provided to ease the penetration and descent in the ground 19, first of the starter panel module 28, and then of the row 25 of increasing length form by the starter panel module 28 and the plurality of main panel module 30 attached thereto and to one another (see FIG. 6, which shows two such rows 25).

The back face 104 is provided with a plurality of reinforcing elongated protrusions 114 to add rigidity to the panel 28 to prevent deformation thereof under the impact force of the tool 24 used to force a row 25 of panels 28-30 into the ground 19.

According to another illustrative embodiment, the number, configuration or location of the protrusions 114 is different than illustrated, depending, for example, on the nature of the sealing material 22, but mainly on the material used in molding the modules 30.

The upper ends 116 of the central protrusions 50 are flat and together define a first support ledge for the jackhammer-to-panel module coupler 34.

The back face 104 includes a trapezoid upper portion 40 that extends upwardly beyond the front face 102 along most of the width of the module 28 and defines a male connecting portion that is configured and sized to be complementary received the trapezoid upper portion 40 of a module 30 when the two modules are mounted coplanar one on top of the other.

The trapezoid upper portion 40 defines a shoulder portion 118 with the front face 102, which defines a second support ledge for the jackhammer-to-panel module coupler 34, the upper end 120 of the trapezoid upper portion 40 defining a third support ledge for the jackhammer-to-panel module coupler 34.

The upper side of the back face 104 is provided with two female locking members 115, each being vertically aligned with a corresponding male locking portions 68 of a main panel module 30 when they aligned for complementary engagement as described hereinabove.

The first and second lateral side portions 108 and 110 include grooves 122 and 124 respectively, the former being opened on the side of the front face 102 and the latter being opened on the side of the back face 104, and each defining an outer lateral rail 126 and 128.

Similar to what has been previously described in FIG. 5 with reference to the panel module 30, the first and second side portions 44 and 46 of a main panel module 30 can be slidably engaged with first and second side portions 108-110, by inserting from the top, the rails 126 or 128 of a main panel module 30, in the groove 122 or 124 of a starter panel module 28, and then by simply relatively sliding one into the other.

According to the first illustrative embodiment, the dimensions of the rectangular part of a main panel module 30 is about 52 cm×18.7 cm×2.9 cm (about 20"½×7"⅜×1"⅛). Those of the starter panel module 28 are about 52 cm×12.7 cm×2.9 cm (20"½×5"×1"⅛).

The starter and main panel modules 28 and 30 are however not limited to those dimensions.

The installation of the modular covering panel 16 will now be described in more detail with reference to FIGS. 6 and 10.

As a previous step before the installation of the modular covering panel 16, a prospection tool (not shown), such as a drill with a long drill bit, can be used to explore the ground 19 along part of the foundation 14 including the crack 12, to make sure that there is no obstacle that could prevent the installation of the modular panel 16. In such a case, such an obstacle can be removed, when possible.

A starter panel module 28 is first partially inserter in the ground 19, flush with the foundation 14 and registered with the upper portion 130 of the crack 12 in the foundation 14, with its bezeled portion 28 oriented downwardly, so as to be the first portion of the panel module 28 to contact the ground 19.

A percussion tool, such as a jackhammer 24 is then used to force the starter panel module 28 within the ground 19. Another percussion tool or a pressuring tool, such as a hydraulic jack (not shown), can also be used.

While the upper portion 40 of the starter panel module 28 is still above the ground 19, a first main panel module 30' is secured to the starter panel module 28 thereon as described hereinabove, and the percussion tool 24 is used on the first main panel module 30' to force both this first main panel module 30' and the starter panel module 28 under it further into the ground 19.

While the upper portion 40 of the first main panel module 30' is still above the ground 19, a second main panel module 30" is secured to the first main panel module 30' and this process continues until the lower edge 127 of the starter panel module 28 reaches the footing 129 of the foundation 14. The user 11 knows that this position is reached, for example when operating the tool 24 on the topmost main panel module 30 of a row 25 of panels 28-30, and he/she is no longer able to further lowering the row 25. In some applications, it can also be possible to evaluate the depth of the crack 12 into the ground 19 by visual inspection inside the basement of the building.

In some cases, when one knows the depth of the crack 12, it can be sufficient to create rows 25 of panels 29-30 having a length just sufficient to reach some predetermined distance below the crack 12. It is however advisable to construct rows 25 that reach the footing 129 anyway, considering that the crack 12 might continue to grow.

When a first row 25 of panels 28-30 is finished installing, the installation process continues with the installation of a further row 25 adjacent the first row 25 and connected thereto as described hereinabove, each new panel 28 or 30 being first connected to the previous row 25 of panel 28-30 as described hereinbelow with reference to FIG. 5.

It results from the previously described installation steps a modular covering panel 16 that defines a rigid open-top pocket on the foundation wall 14.

Figure 8:
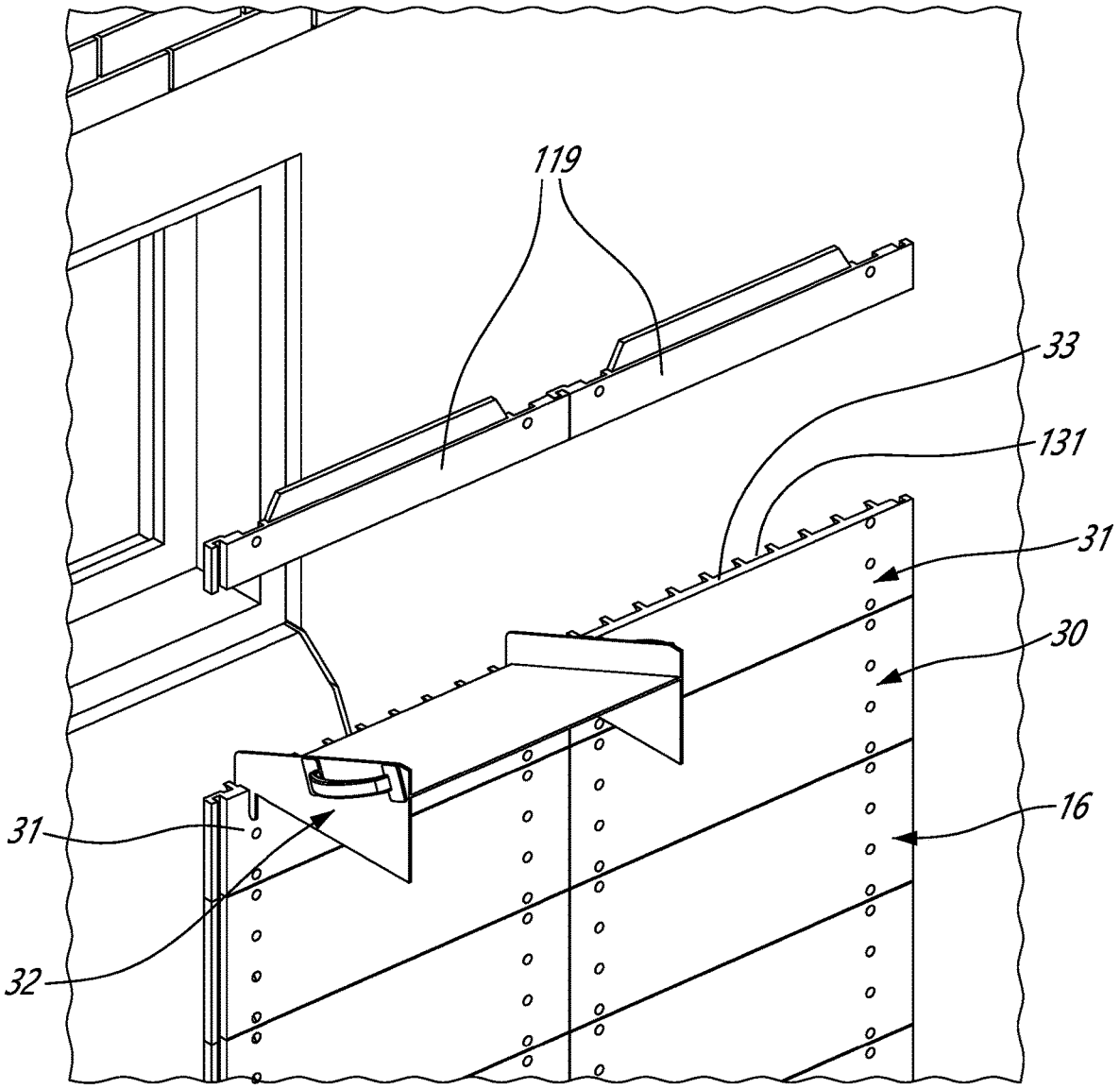
FIG. 8 is close-up front perspective view of FIG. 6, further illustrating the removal of the top portion of the two rows of panel modules and the filling of the resulting rigid pocket with a hardening sealing material.

Since the bezeled lower portion 106 of the starter panel modules 28 is shaped to define a scraper, descending the starter panel modules 28 when forming the rows 25 of panels 28-30 removes most of the soil and other soil constituents, such as small rocks, in the interspace 131 between the foundation 14 and panel 16 (see, for example, on FIG. 8).

As shown in FIG. 8, the upper portion 119 of the upmost panel module 30 in each row 25 can be cut for aesthetic purposes using a radial saw (not shown) or another cutting tool (not shown), leaving, for example, about 10 cm (about 4 inches) of the then cut panels 31 above the ground 19 and a straight edge 33.

The upper panels 31 can be further attached to the foundation 14 by using fasteners (not shown). The recesses 48 can be used as guides for receiving fasteners (not shown).

Figure 9:
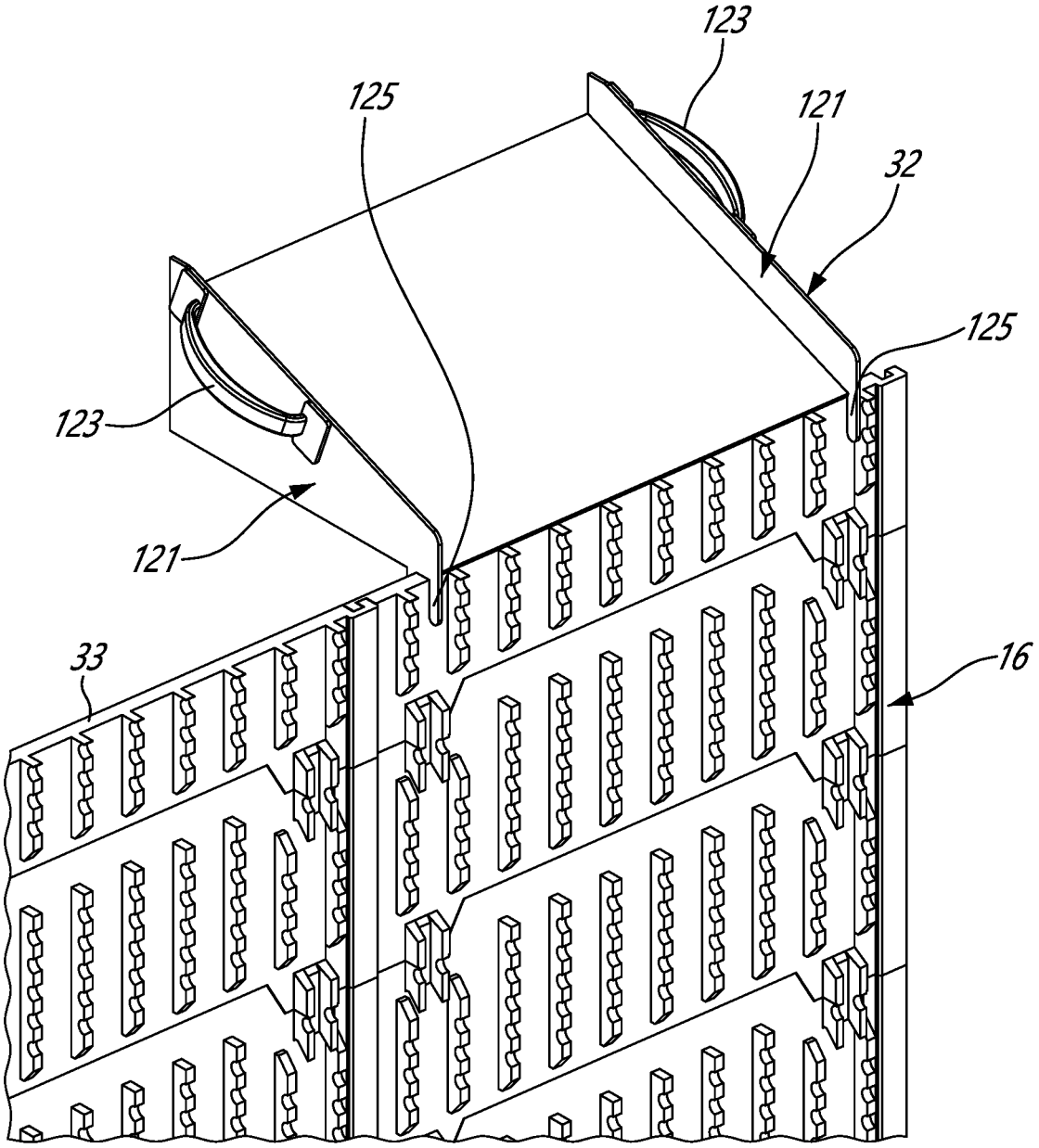
FIG. 9 is a close-up back perspective view of FIG. 6.
Figure 10:
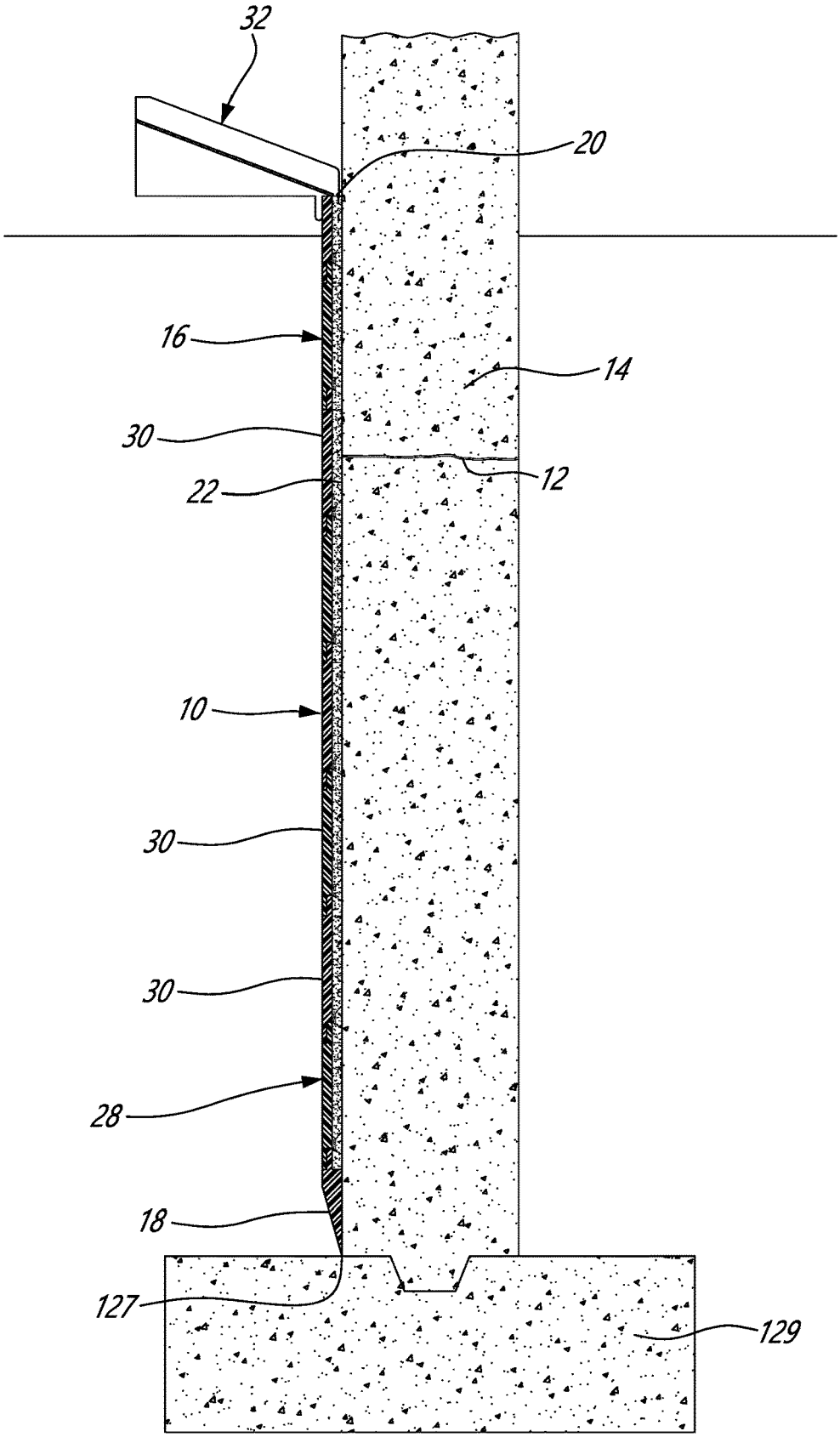
FIG. 10 is a side sectional view illustrating the filling with the hardening sealing material of a rigid open-top pocket formed using the main and starter panel modules according to the illustrative embodiment.

FIGS. 8-10 illustrates the steps of filling the interspace 131 with the hardening sealing material 22.

The hardening sealing material 22 is in the form of a cementitious grout whose quantity of mixing water is adjusted to yield a fluid that easily makes its way through all the interspace 131, and more specifically through the notches 54 of the panels 28-30. It is believed to be within the reach of a person skilled in the art to prepare a mixture of a cementitious grout that can be poured in the interspace 131 as a liquid.

According to a more specific embodiment, the sealing material 22 is in the form of SikaGrout®-212 non-shrink, cementitious grout.

According to other illustrative embodiments, other sealing material can be used, such as a self-leveling synthetic resin, including epoxy and urethane resins.

The sealing material discharger 32 can be used to ease the filling of the pocket defined by the modular panel 16.

To provide an improve stability when filling the material 22, the sealing material discharger 32 is advantageously provided with lateral flanges 121, each including a handle 123 and, at their distal ends, a U-shaped portion 125 that is configured for complementary mounting to the straight edge 33 of the upper most panel modules 31.

According to another embodiment, another filling tool than a ramp 131 can be used.

Figure 13:
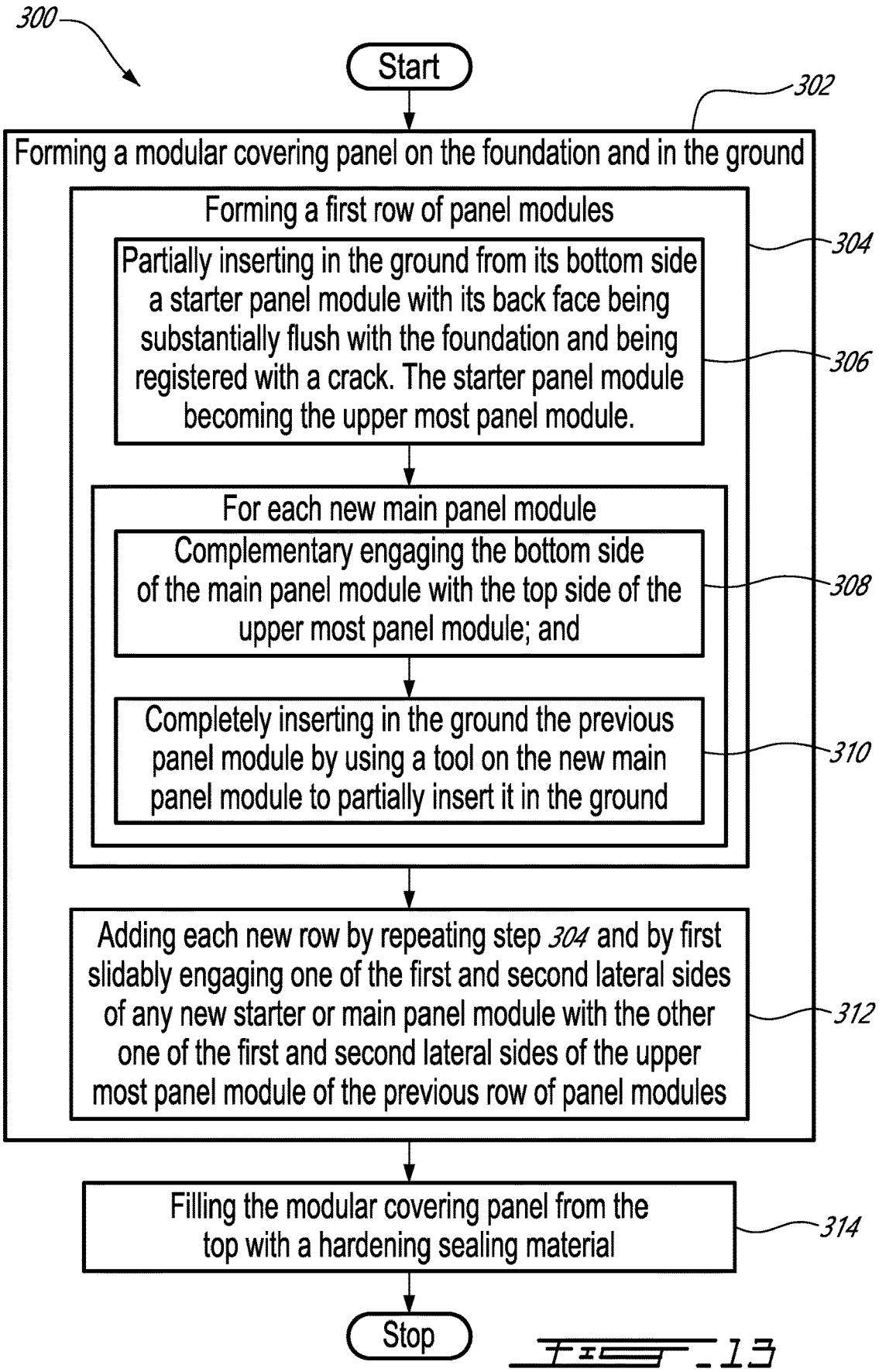
FIG. 13 is a flowchart illustrating a process for sealing a crack in a foundation according to a first illustrative embodiment.

A process 300 for sealing a crack 12 in a foundation 14 is summarized in FIG. 13.

Figure 11:
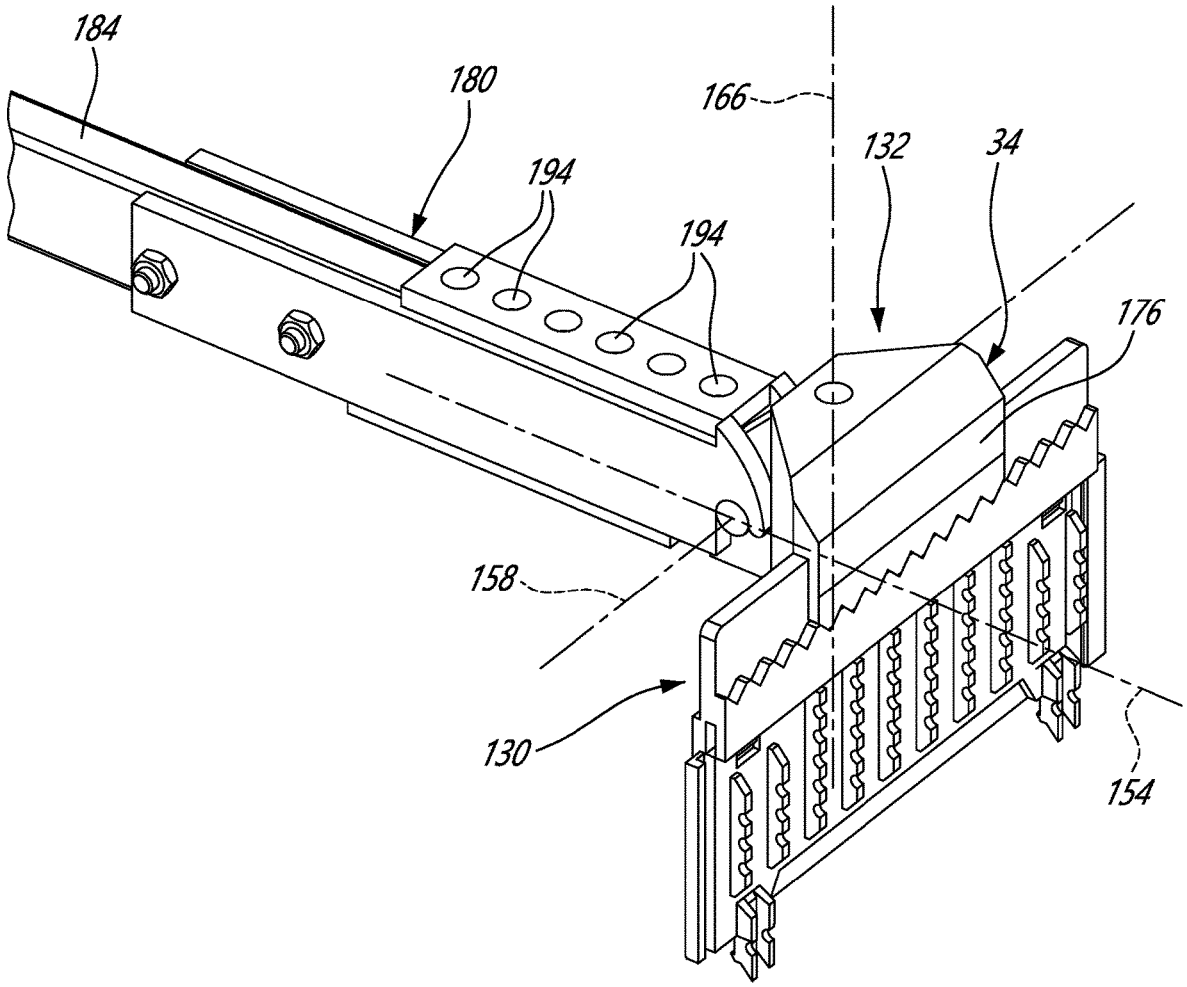
FIG. 11 is a close-up back perspective view illustrating the operational assembly of the extension arm and jackhammer coupler to a main panel module from the first illustrative embodiment.
Figure 12:
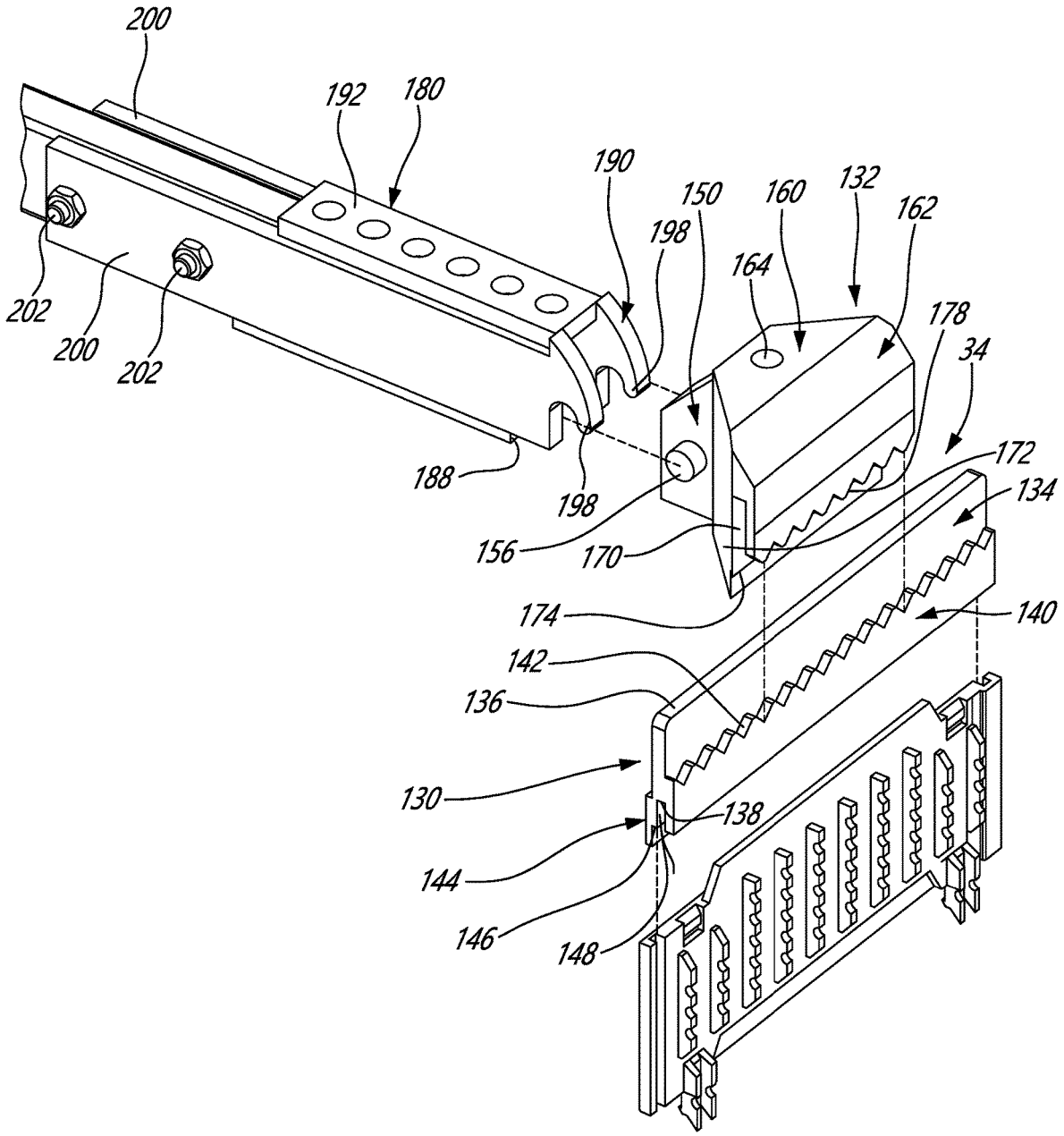
FIG. 12 is an exploded view of the operational assembly from FIG. 11.

Turning to FIGS. 11 and 12, the jackhammer-to-panel module coupler 34 will now be described in more detail.

The jackhammer-to-panel coupler 34 includes a panel-side part 130 and a tool-side part 132 that is adjustably mountable to the panel-side part 130.

The panel-side part 130 is one-piece body in the form of an elongated plate having an inverted Y-shaped section defined by a first flat support portion 134 having an upper edge 136 and a lower edge 138, a second serrated flat support portion 140 that extends from the first flat portion 134 on a first lateral side thereof and parallel thereto, beyond the lower edge 138 and having a serrated edge 142 facing upwardly, and a third flat portion 144 extending from the first flat portion 134 on a second lateral side thereof and parallel thereto, beyond the lower edge 138 so as to define a shoulder portion 146 therewith. The gap between the second and third flat portion defines a groove 148 whose bottom is the lower edge 138 of the first flat portion 134. The tool-side part 132 is thus shaped to complementary engage a panel module 28 or 30 by its upper portion 40 or 115 respectively, wherein the lower edges of the first, second and third flat portions 134, 140 and 144 abut respectively the support ledges 66/118, 58/116 and 64/120 of the main/starter panel modules 30/28.

The tool-side part 132 is one-piece body having on a first side along a first axis 154, an attachment portion 150 and on the other side, a coupling portion 152.

The attachment portion 150 includes two attachment pins 156, extending therefrom along a second axis 158 that is perpendicular to the first axis 154.

The coupling portion 152 includes a front portion 160, on the side of the attachment portion 150, and a back portion 162, extending from the front portion 160 on a side thereof opposite the attachment portion 150.

The front portion 160 includes a tool-coupling bore 164 extending along a third axis 166 perpendicular to both the first and second axes 154 and 158. The bore 164 is adapted to receive the impact tip 168 of the jackhammer 24. According to another illustrative embodiment, the bore 164 can be replaced by a hole or by another coupling portion or part (not shown) adapted for operatively coupling with another tool (not shown).

The back portion 162 is generally configured to complementary engage the upper portion of the panel-side part 130.

More specifically, the back portion 162 includes a groove 170 for receiving the first flat portion 134 of the panel-side part 130. The groove 170 is defined by a front wall 172, provided with a shoulder portion 174, and a second wall 176, provided with a serrated edge 178 for complementary engaging the serrated edge 142 of the panel-side part 130.

In operation, the panel-side part 130 is first mounted on a starter panel module 28 or on the upper panel module 30 of a row 25 of panels being inserted in the ground 19. Secondly, the tool-side part 132 is mounted thereon, and thirdly the impact tip 168 of the jackhammer 24 is inserted in the bore 166. Operation of the jackhammer 24 will then force the row 25 of panels 28 and 30 to further descent in the ground 19.

A person skilled in the art will now appreciate that providing serrated edges 142 and 178 on both the panel-side and tool-side parts 130 and 132, allows stably mounting the tool-side part 132 at different lateral positions along the panel-side part 130, allowing the tool 24 to impact more strongly on one side than the other, which can be useful when more resistance is met on one side within the ground 19.

While the tool-side part 132 has a length similar to the length of the panel modules 28 and 30, it can be shaped so as to have a different length thereof.

Both the panel and tool-side parts 130-132 are made of steel so as to be heavy and sturdy.

According to another illustrative embodiment, jackhammer-to-panel module coupler 34 is made of another sturdy material. According to some illustrative embodiment, the jackhammer-to-panel module coupler is a one-piece body or is made of more or than two parts.

The coupler 34 is not limited to the illustrative embodiment. For example, the adjustability of the lateral position of the tool-side part 132 on the panel-side part 130 is not limited to the illustrated serrated coupling. For example, any other complementary shape on the tool-side and panel-side parts 132, 130 that can prevent relative lateral movements thereof can alternatively be used. Also, a locking mechanism can be used between the two parts 130-132.

According to still another illustrative embodiment, the coupler 34 is configured for coupling another tool (not shown) to the panel modules 28 and 30. It can also be omitted.

Figure 7:
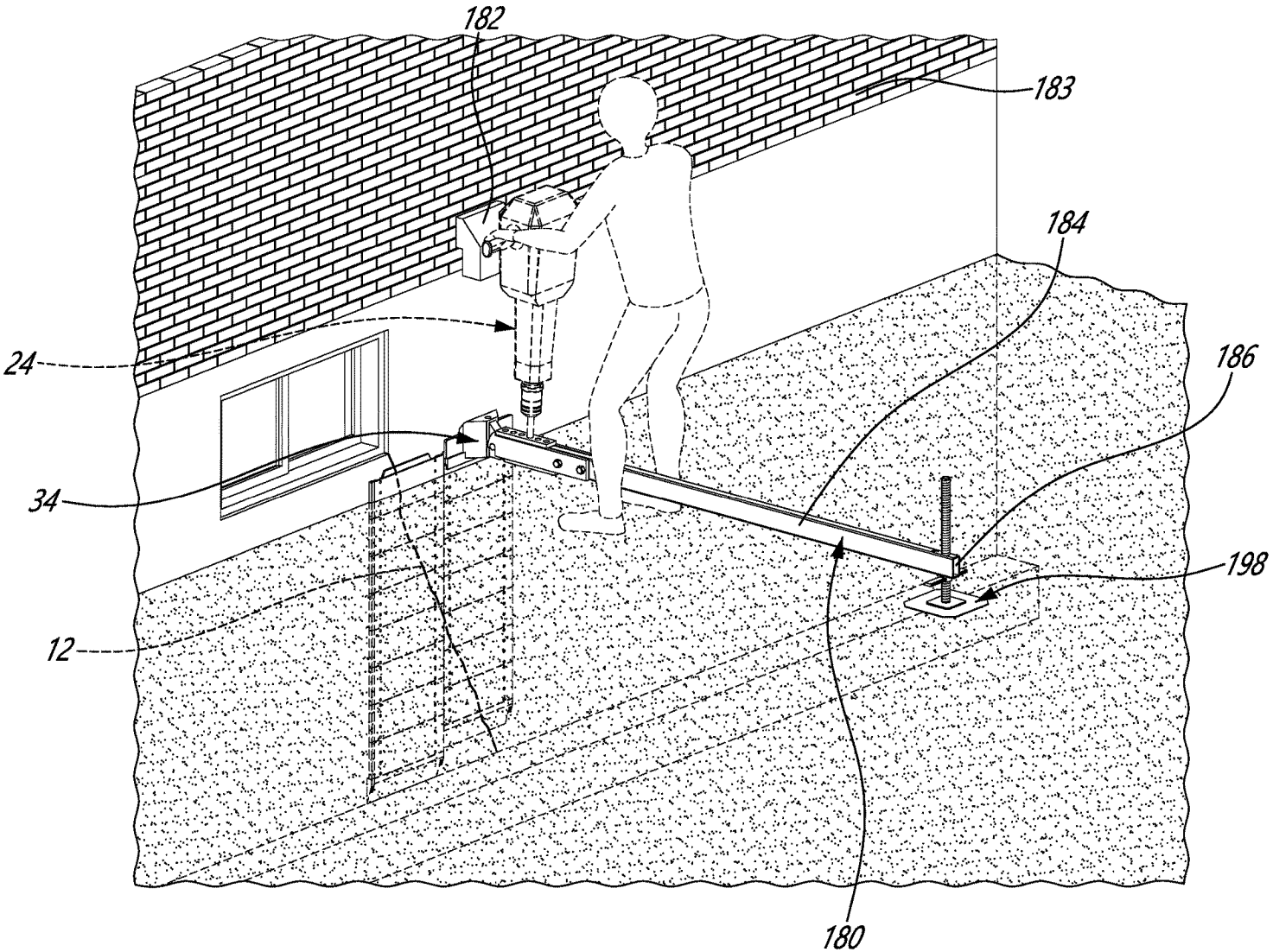
FIG. 7 is a front perspective view similar to FIG. 6, further illustrating the use of an extension arm to use the jackhammer in a case where there is not enough clearance for the equipment adjacent the foundation.

As can be seen in FIGS. 7, 11 and 12, an extension arm 180 can be used in cases where the coupler 34 is difficult to reach from above by the tool 24, for example when an air exhaust 182 or another equipment or feature is mounted to the building wall above the crack 12.

The extension arm 180 comprises an elongated beam 184, having proximate and distal ends 186-188, a coupling head 190 secured to the beam 184 at the distal end 188 thereof, a tool-coupling portion in the form of a perforated plate 192 mounting to the beam 184 adjacent the coupling head 190 and having a plurality of equally distanced tool-coupling holes 194 therein, and a height-adjustable leg 196 mounted to the beam 184 near the proximate end 186 thereof. Since a height adjustable leg is believed to be well-known in the art, it will not be described herein in more detail.

The coupling head 190 includes two parallel hooks 198 that are configured for coupling to the two attachment pins 156 of the coupler 34. The hooks 198 are integral to mounting plates 200 secured to the beam 184 using fasteners 202.

According to the first illustrative embodiment, the parts of the arm 180 are made of steel, but they can be made of any material sufficiently rigid to withstand the impact of tool 24.

The arm 180 is not limited to the illustrated embodiment. For example, the height-adjustable leg 196 can be replaced by a fixed leg, and/or the coupling head 190 and the tool-coupling portion 192 can be different than illustrated. The arm 180 can also be omitted.

It is to be noted that many modifications could be made to the system and process for sealing a foundation crack described hereinabove and illustrated in the appended drawings. For example:

- the proportions and dimensions of the starter and main panel modules 28 and 30 may be different than illustrated;
- other mechanisms than those illustrated can be provided for locking or attaching one on top of the other two main panel modules 30 or a main panel module 30 with a starter panel module 28;
- other sliding members or mechanisms than those illustrated can be provided for lateral slidable engagement of two main panel modules 30 or a main panel module 30 with a starter panel module 28.

Although a system and process for sealing or preventing a foundation crack has been described hereinabove by way of illustrated embodiments thereof, it can be modified. It is therefore to be understood that numerous modifications may be made to the illustrative embodiments and that the scope of the claims should not be limited by the illustrative embodiments but should be given the broadest interpretation consistent with the description as a whole.

What is claimed is:

1. A system for sealing or preventing a crack in a foundation, the system comprising:

a modular covering panel having a bezeled lower edge defining a blade to ease insertion and lowering of the covering panel in a ground along the foundation, in contact therewith; the modular covering panel being configured to define a rigid open-top pocket on the foundation to receive a hardening sealing material so as to define a waterproof barrier on the foundation.

2. The system as recited in claim 1, further comprising the hardening sealing material.

3. The system as recited in claim 2, wherein the hardening sealing material is a non-shrink cementitious grout or a self-leveling synthetic resin.

4. The system as recited in claim 1, wherein the modular covering panel includes starter panel modules, together defining the beveled lower edge, and main panel modules that are mounted coplanar in a row on top of the starter panel modules.

5. The system as recited in claim 4, wherein each of the main panel modules includes complementary engaging top and bottom sides; a first one of the top and bottom sides including a male connecting portion and a second one of the complementary engaging top and bottom sides includes a female connecting portions; each of the starter panel modules includes a top side that is configured for complementary engagement with the bottom side of each of the plurality of main panel modules.

6. The system as recited in claim 4, wherein each of the main panel modules includes at least one first locking member on the top side thereof and at least one second locking member on the bottom side thereof for complementary locking engagement with the first locking member; each of the starter panel modules including at least one other first locking member on the top side for complementary locking engagement with the at least one second locking member.

7. The system as recited in claim 4, wherein each of the main panel modules includes first and second lateral sides, each provided with respectively first and second cooperating slidable members for slidable engagement with respectively the second and first cooperating slidable members of another main panel module; each of the starter panel modules includes first and second lateral sides, each provided with third and fourth cooperating slidable members for slidable engagement with respectively the fourth and third cooperating slidable members of another starter panel module and with respectively the second and first cooperating slidable members of each main panel module.

8. The system as recited in claim 7, wherein the first and second cooperating slidable members of the main panel modules includes respectively a first groove and a first rail; the third and fourth cooperating slidable members of the starter panel modules includes respectively a second groove and a second rail.

9. The system as recited in claim 4, wherein each of the starter and main panel modules has a front face that is substantially smooth, and a back face that includes reinforcement protrusions.

10. The system as recited in claim 9, wherein at least one of the main panel modules includes at least one recess on the front face, which defines a fastener receiving guide.

11. The system as recited in claim 9, wherein at least one of the reinforcement protrusions includes at least one notch therein.

12. The system as recited in claim 4, wherein each of the starter panel modules includes a back face including a substantially flat portion for contacting with the foundation and a front face that includes a portion defining an acute angle with the back face and defining the beveled lower edge of said each of the starter panel module.

13. The system as recited in claim 1, wherein the modular covering panel is made of a hard polymeric material.

14. A kit for sealing a crack in a foundation, the kit comprising:

a plurality of main panel modules, each including front and back faces, complementary engaging top and bottom sides that are adapted to join two of the main panel modules coplanar one on top of another when the front side faces thereof are on a same side, and complementary interlocking first and second lateral sides that are adapted for joining two of the main panel modules side by side when the front side faces thereof are on a same side; the first and second lateral sides of each main panel modules being further configured for relative slidable engagement; and a plurality of starter panel modules, each including front and back faces, top and bottom sides, and complementary interlocking first and second lateral sides that are adapted for joining two of the starter panel modules side by side when the front side faces thereof are on a same side; the first and second lateral sides of each starter panel modules being further configured for relative slidable engagement with respectively the second and first lateral sides of i) another starter panel module or ii) one of the plurality of main panel modules, when the front side faces thereof are on a same side; the top side of each starter panel module being configured for complementary engagement with the bottom side of any one of the plurality of main panel modules; the bottom side of each starter module being tapered, yielding a slanted portion on the front face thereof, wherein a bottom edge thereof is the thinnest portion thereof so as to facilitate an insertion of each starter panel module in a ground;

whereby, in operation, a least one of the plurality of starter panel modules and the plurality of main panel modules being assembled one row after another, and for each row, in sequence, the at least one of the plurality of starter panel modules and then a plurality of main panel modules coplanar one on top of the other to form a modular covering panel in the ground; the modular covering panel being configured to define a rigid pocket on the foundation.

15. The kit as recited in claim 14, further comprising a hardening material for filling the rigid pocket.

16. The kit as recited in claim 15, wherein the hardening material is a cementitious grout.

17. The kit as recited in claim 16, wherein the cementitious grout is non-shrink.

18. The kit as recited in claim 14, further comprising a sealing material discharger.

19. The kit as recited in claim 14, wherein the plurality of main and starter panel modules are made of a hard polymeric material.

20. The kit as recited in claim 14, wherein each of the starter and main panel modules has a front face that is substantially smooth, and a back face that includes reinforcement protrusions.

21. The kit as recited in claim 20, wherein at least one of the reinforcement protrusions includes at least one notch therein.

22. The kit as recited in claim 20, wherein at least one of the main panel modules includes at least one recess on the front face, which defines a fastener receiving guide.

23. The kit as recited in claim 14, wherein a first one of the complementary engaging top and bottom sides of each of the plurality of main panel modules includes a male connecting portion and a second one of the complementary engaging top and bottom sides includes a female connecting portions; the top side of each of the plurality of starter panel modules being configured for complementary engagement with the bottom side of each of the plurality of main panel modules.

24. The kit as recited in claim 23, wherein the male connecting portion is trapezoid-shaped.

25. The kit as recited in claim 14, wherein each of the plurality of main panel modules includes at least one first locking member on the top side thereof and at least one second locking member on the bottom side thereof for complementary locking engagement with the first locking member; each of the plurality of starter panel modules including at least one other first locking member on the top side thereof for complementary locking engagement with the at least one second locking member.

26. The kit as recited in claim 25, wherein each of the main panel modules includes first and second lateral sides, each provided with respectively first and second cooperating slidable members for slidable engagement with respectively the second and first cooperating slidable members of another main panel module; each of the starter panel modules includes first and second lateral sides, each provided with cooperating third and fourth slidable members for slidable engagement with respectively the fourth and third cooperating slidable members of another starter panel module and with respectively the second and first cooperating slidable members of each main panel module.

27. The kit as recited in claim 14, wherein each of the main panel modules includes first and second lateral sides, each provided with respectively first and second cooperating slidable members for slidable engagement with respectively the second and first cooperating slidable members of another main panel module; each of the starter panel modules includes first and second lateral sides, each provided with cooperating third and fourth slidable members for slidable engagement with respectively the fourth and third cooperating slidable members of another starter panel module and with respectively the second and first cooperating slidable members of each main panel module.

28. The kit as recited in claim 27, wherein the first and second cooperating slidable members of the main panel modules includes respectively a first groove and a first rail; the third and fourth cooperating slidable members of the starter panel modules includes respectively a second groove and a second rail.

29. The kit as recited in claim 14, wherein each of the main panel modules includes complementary engaging top and bottom sides; a first one of the complementary engaging top and bottom sides including a male connecting portion and a second one of the complementary engaging top and bottom sides includes a female connecting portions; each of the starter panel modules includes a top side that is configured for complementary engagement with the bottom side of each of the plurality of main panel modules.

30. The kit as recited in claim 14, further comprising a tool-to-panel module coupler including i) a panel-side part for removably and stably mounted to the top side of one of the main and starter panel modules, and ii) a tool-side part extending from the panel-side part and having a tool attachment portion for operatively coupling a jackhammer or another tool to the tool-side part.

31. The kit as recited in claim 30, wherein the panel-side part is removably mounted to the tool-side part.

32. The kit as recited in claim 31, wherein the panel-side part is elongated, and both the panel-side and tool-side parts are configured to allow mounting the tool-side part at any one of a plurality of lateral positions along the panel-side part.

33. A process for sealing or preventing a crack in a foundation, the process comprising:

inserting in a ground, flush along the foundation, one row after another, and for each row, in sequence, a starter panel module and then a plurality of main panel modules coplanar one on top of the other to form a modular covering panel along the foundation; a bottom side of the starter panel module being tapered so as to ease an insertion of the starter panel module in the ground; a top side of each of the starter and main panel modules being configured for complementary engagement with a bottom side of the main panel modules; together the rows of starter and main panel modules defining a rigid open-top pocket on the foundation.

34. The process as recited in claim 33, further comprising filling the open-top pocket with a hardening sealing material to define a waterproof barrier on the foundation.

35. The process as recited in claim 34, wherein the hardening material is a cementitious grout.

36. The process as recited in claim 35, wherein the cementitious grout is non-shrink.

37. The process as recited in claim 33, further comprising, prospecting the ground to search for an obstacle in the ground in front of the foundation prior to said inserting in the ground step.

38. The process as recited in claim 33, wherein said inserting in the ground step is performed using a jackhammer.

39. The process as recited in claim 33, wherein the foundation includes a footing; the modular covering panel abutting the footing.

40. The process as recited in claim 33, further comprising cutting transversally a portion of the modular covering panel that extends above the ground.

41. A process for sealing a crack in a foundation, the process comprising:

providing a plurality of main panel modules, each including front and back faces, complementary engaging top and bottom sides that are adapted to join two of the main panel modules coplanar one on top of another when the front side faces thereof are on a same side, and complementary interlocking first and second lateral sides that are adapted for joining two of the main panel modules side by side when the front side faces thereof are on a same side; the first and second lateral sides of each main panel modules being further configured for relative slidable engagement;

providing a plurality of starter panel modules, each including front and back faces, top and bottom sides, and complementary interlocking first and second lateral sides that are adapted for joining two of the starter panel modules side by side when the front side faces thereof are on a same side; the first and second lateral sides of each starter panel modules being further configured for relative slidable engagement with respectively the second and first lateral sides of i) another starter panel module or ii) one of the plurality of main panel modules, when the front side faces thereof are on a same side; the top side of each starter panel module being configured for complementary engagement with the bottom side of any one of the plurality of main panel modules; a portion of each starter module being tapered towards the bottom side thereof, yielding a slanted portion on the front face thereof, wherein the bottom edge thereof is the thinnest portion thereof so as i) to facilitate an insertion of each starter panel module in a ground, and ii) scrape the foundation;

attaching in a first row one of the plurality of starter panel modules and a number of the plurality of main panel modules by:

1) Partially inserting in the ground one of the plurality of starter panel modules from the bottom side of said one of the plurality of starter panel modules with the back face of said one of the plurality of starter panel modules being substantially flush with the foundation; said one of the plurality of starter panel modules becoming an upper most panel module;

2) Sequentially attaching each of the number of the plurality of main panel modules by:

a) complementary engaging the bottom side of said each of the number of the plurality of main panel modules with the top side of the upper most panel module; and b) completely inserting in the ground the previous panel module by partially inserting in the ground said each of the number of the plurality of main panel modules;

the first row becoming a previous row;

adding each new row by repeating 1) and 2) by first slidably engaging one of the first and second lateral sides of any new one of the plurality of starter and main panel modules with the other one of the first and second lateral sides of the upper most panel module of the previous row of modules.

* * * * *